US006730375B2

(12) United States Patent
Moriya et al.

(10) Patent No.: US 6,730,375 B2
(45) Date of Patent: May 4, 2004

(54) INK-JET RECORDING MEDIUM

(75) Inventors: Kenichi Moriya, Chiba (JP); Kenji Shinjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 139 days.

(21) Appl. No.: 10/023,872

(22) Filed: Dec. 21, 2001

(65) Prior Publication Data

US 2002/0136868 A1 Sep. 26, 2002

(30) Foreign Application Priority Data

Dec. 27, 2000 (JP) ..... 2000-397890
Dec. 27, 2000 (JP) ..... 2000-397891

(51) Int. Cl.[7] ..... B41M 5/00
(52) U.S. Cl. ..... 428/32.37; 428/32.25; 428/32.38
(58) Field of Search ..... 428/32.13, 32.25, 428/32.37, 32.38

(56) References Cited

U.S. PATENT DOCUMENTS

| | | | | |
|---|---|---|---|---|
| 4,317,849 | A | 3/1982 | Ogura et al. | 427/362 |
| 4,785,313 | A | 11/1988 | Higuma et al. | 346/135.1 |
| 5,374,475 | A | 12/1994 | Wälchli | 428/304.4 |
| 5,733,637 | A | 3/1998 | Moriya et al. | 428/207 |
| 5,747,146 | A | 5/1998 | Kashiwazaki et al. | 428/206 |
| 5,985,453 | A | 11/1999 | Moriya et al. | 428/411.1 |
| 6,096,440 | A | 8/2000 | Moriya et al. | 428/522 |
| 6,114,020 | A | 9/2000 | Misuda et al. | 428/212 |
| 6,203,899 | B1 | 3/2001 | Hirose et al. | 428/341 |
| 6,244,701 | B1 | 6/2001 | Moriya et al. | 347/105 |

FOREIGN PATENT DOCUMENTS

| | | | |
|---|---|---|---|
| EP | 0 858 905 | A1 | 8/1998 |
| JP | 59-22683 | A | 2/1984 |
| JP | 59-222381 | A | 12/1984 |
| JP | 62-140878 | A | 6/1987 |
| JP | 62-140879 | A | 6/1987 |
| JP | 62-271785 | A | 11/1987 |
| JP | 62-280067 | A | 12/1987 |
| JP | 6-55870 | A | 3/1994 |
| JP | 7-237348 | A | 9/1995 |
| JP | 8-2090 | A | 1/1996 |
| JP | 8-99457 | A | 4/1996 |

OTHER PUBLICATIONS

Patent Abstracts of Japan, vol. 008, No. 106 (C–223), May 18, 1984 with respect to JP 59–022683A of Feb. 4, 1984.
Patent Abstracts of Japan, vol. 015, No. 467 (C–0888), Nov. 27, 1991 with respect to JP 3–199484 A of Aug. 30, 1991.

*Primary Examiner*—B. Hamilton Hess
(74) *Attorney, Agent, or Firm*—Fitzpatrick, Cella, Harper & Scinto

(57) ABSTRACT

An ink-jet recording medium having, on a base material, a porous resin layer containing water-dispersible resin particles B having a minimum film-forming temperature of not lower than 0° C., and water-dispersible resin particles A having a minimum film-forming temperature higher than the film-forming temperature of the water-dispersible resin particles B and having an average particle size larger than the average particle size of the water-dispersible resin particles B.

14 Claims, 1 Drawing Sheet

FIGURE
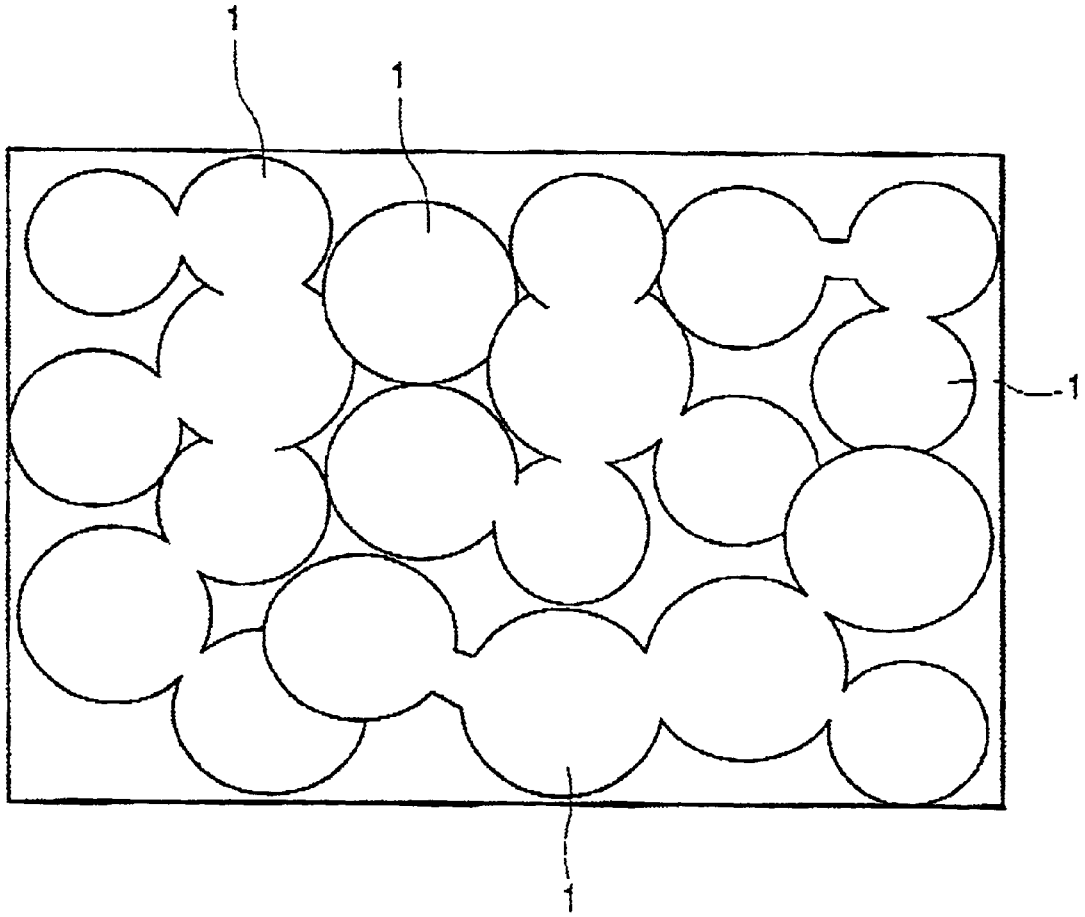

INK-JET RECORDING MEDIUM

BACKGROUND OF THE INVENTION

1. Field of the Invention

The present invention relates to a recording medium suitable for ink-jet recording.

2. Related Background Art

The ink-jet recording system conducts recording by ejecting ink droplets by a variety of ink ejection methods utilizing electrostatic suction, mechanical vibration or alternation of ink caused by a piezo element, bubbling of ink caused by heating, or the like method to deposit entire or a part of the ejected ink onto a recording medium such as a paper sheet, and a plastic film having an ink-receiving layer thereon. The ink-jet recording system is attracting attention owing to less noise generation, high speed of printing, and suitability for multi-color printing. The ink-jet recording systems are developed and are coming to be used widely as printers, copying machines, word processors, facsimile machines, plotters, and other information machines.

In recent years, digital cameras, digital videos, and scanners of high performance are supplied at low prices. With the wide use of personal computers, there increase chances of outputting the images of the above imaging instruments by the ink-jet system. Therefore, the ink-jet printing quality is required to be comparable with the quality of multi-color printing by silver salt type photograph or by a gravure system.

To meet the requirement, various improvements of ink-jet recording apparatuses and recording systems have been made, such as increase of the recording speed, increase of print fineness, improvement of full color printing quality, and so forth. On the other hand, the recording medium therefor is also required to have higher performance. The recording medium is also required to be capable of giving printed matters having gloss and high weatherability.

Various techniques have been disclosed therefor. For example, Japanese Patent Application Laid-Open No. 59-22683 discloses a highly ink-absorbent glossy printing sheet produced by coating with a two or more kinds of thermoplastic resin particles having different minimum film forming temperatures on a base material sheet face, and drying to form a film having cracks on the surface.

Japanese Patent Application Laid-Open Nos. 59-222381, 6-55870, 7-237348, and 8-2090 disclose methods for improvement of water resistance and weatherability of the printed image by use of a recording medium produced by forming a layer constituted of water-dispersible resin particles on the pigment layer surface, drying the layer at a temperature not higher than the glass transition temperature (Tg) of a thermoplastic resin particles to prepare a recording medium, and transforming the surface layer into a surface film after printing.

Japanese Patent Application Laid-Open No. 08-099457 discloses a recording medium having a layer containing an aqueous resin particles dispersed in a continuous surface film of a binder for improvement of ink fixability.

Japanese Patent Application Laid-Open No. 62-280067 discloses a recording medium having a melting temperature of not lower than 50° C. Japanese Patent Application Laid-Open No. 62-1.40878 discloses a recording medium having a layer mainly composed of a particulate resin and a binder. Japanese Patent Application Laid-Open No. 62-271785 discloses a recording medium having a layer mainly constituted of a non-dyeable particle and a binder. Japanese Patent Application Laid-Open No. 62-140879 describes a recording medium having a layer having thermal adhesiveness/pressure adhesiveness.

However, the printing sheet disclosed in Japanese Patent Application Laid-Open No. 59-22683 does not have sufficient abrasion resistance owing to the fine cracks formed on the surface. The recording mediums disclosed in Japanese Patent Application Laid-Open No. 59-222381 and so forth are not sufficient in adhesiveness between the base material and particles owing to the heat treatment at a temperature lower than Tg, and are liable to be scratched owing to low abrasion resistance of the surface layer containing water-dispersible resin particles, and not steadily forming a uniform surface film on heating for transparency after printing, not giving high-quality images steadily, disadvantageously. The recording medium disclosed in Japanese Patent Application Laid-Open No. 08-099457, which has high abrasion resistance owing to the aqueous resin particles retained in the continuous binder surface film, is not suitable for the recent high-speed printing with the disclosed ink absorbency.

The recording mediums disclosed in Japanese Patent Application Laid-Open Nos. 62-280067, 62-140878, 62-271785, 62-140879, and so forth are not satisfactory in abrasion resistance of the recording face, sharpness of the image, and photographic image quality of high surface gloss which are required in recent years.

SUMMARY OF THE INVENTION

The object of the present invention is to provide a recording medium which offsets the above disadvantages of conventional recording mediums and has sufficient ink absorbency and high abrasion resistance.

The above object can be achieved by the present invention described below.

The recording medium of the present invention has, on a base material, a porous resin layer containing water-dispersible resin particles B having a minimum film-forming temperature of not lower than 0° C., and water-dispersible resin particles A having a minimum film-forming temperature higher than that of the water-dispersible resin particles B and having an average particle size larger than that of the water-dispersible resin particles B.

BRIEF DESCRIPTION OF THE DRAWING

The FIGURE illustrates a partially fusion-bonded state of the particles of the water-dispersible resin.

DESCRIPTION OF THE PREFERRED EMBODIMENTS

The recording medium of the present invention is described below in detail.

The recording medium of the present invention has a porous resin layer which contains, as an essential component, water-dispersible resin particles A having a minimum film-forming temperature of not lower than 50° C. and water-dispersible resin particles B having a minimum film-forming temperature of not lower than 0° C. The applied ink penetrates this porous resin layer to reach an ink-absorbent base material or a porous ink-receiving layer, forming an image there. The porous resin layer specified above gives excellent abrasion resistance and high ink absorbency to the recording medium of the present invention.

With only one kind of water-dispersible resin particles employed in the porous resin layer, the bonding strength between the water-dispersible resin particles is weak to result in low abrasion resistance of the recording medium.

With plural kinds of water-dispersible resin particles employed, two of the water-dispersible resin particles should have different minimum film-forming temperatures in order to obtain a porous resin layer excellent in both the ink absorbency and the abrasion resistance. The water-dispersible resin particles of the lower minimum film-forming temperature which has a minimum film-forming temperature of lower than 0° C. will lower the ink-absorbency although the resin layer can be made porous. Presumably, the water-dispersible resin particles B could form the film at a higher speed than the speed of forming bonding between the water-dispersible resin particles A and the water-dispersible resin particles B, not forming sufficient pores, although the reason is not clear.

For a more desirable condition of the porous resin layer, the difference in the minimum film-forming temperatures between the water-dispersible resin particles A and the water-dispersible resin particles B is preferably 50° C. or more, more preferably 60° C. or more, still more preferably 70° C. or more. With smaller difference in the minimum film-forming temperatures between the water-dispersible resin particles A and the water-dispersible resin particles B, the bonding strength between the water-dispersible resin particles tends to be weaker to result in lower abrasion resistance of the porous layer.

For simultaneously achieving the high abrasion resistance and the high ink absorbency, the water-dispersible resin particles A and the water-dispersible resin particles B are partially fusion-bonded in the mixed layer.

The condition that the water-dispersible resin particles A and the water-dispersible resin particles B are partially fusion-bonded in the present invention is schematically shown in FIGURE. As shown in FIGURE, at least two adjacent water-dispersible resin particles 1 of the water-dispersible resin particles A or B are fusion-bonded by heating in a bead-shaped condition or a dumbbel-shaped condition. The fusion-bonded condition of the water-dispersible resin particles 1 are preferably such that the bonding sectional area is in the range from $\pi r^2/400$ to $\pi r^2$ where r denotes the average particle diameter of the water-dispersible resin particles 1.

For more desirable partially fusion-bonded conditions, the water-dispersible resin particles A and the water-dispersible resin particles B are contained in a ratio of preferably 1–40 parts, more preferably 1–20 parts by mass of the water-dispersible resin particles B based on 100 parts by mass of the water-dispersible resin particles A. At a lower content ratio of the water-dispersible resin particles B to the water-dispersible resin particles A, the degree of the fusion bonding between the water-dispersible resin particles may be lowered to result in lower abrasion resistance. Conversely, at a higher content ratio of the water-dispersible resin particles B to the water-dispersible resin particles A, the porosity tends to be lowered to result in lower ink absorbency, although the degree of the fusion-bonding between the water-dispersible resin particles can be increased to give improved abrasion resistance.

For the partially fusion-bonded structure for obtaining the high abrasion resistance and the high ink absorbency simultaneously, the average particle size of the water-dispersible resin particles A having a higher minimum film-forming temperature is larger than that of the water-dispersible resin particles B having a lower minimum film-forming temperature. The average particle size of the water-dispersible resin particles A ranges preferably from 0.1 to 10 μm, more preferably from 0.1 to 82 μm. The average particle size of the water-dispersible resin particles B ranges preferably from 0.01 to 0.3 μm, more preferably from 0.05 to 0.2 μm.

The water-dispersible resin particles A and B include polyvinyl chlorides, polyvinyl acetates, ethylene-vinyl acetate copolymers, polystyrenes, polyacrylic acids, styrene-(meth)acrylate ester copolymers, (meth)acrylate ester copolymers, vinyl acetate/(meth)acrylic acid (ester) copolymers, poly(meth)acrylamides, (meth)acrylamide copolymers, styrene-isoprene copolymers, styrene-butadiene copolymers, ethylene-propylene copolymers, polyvinyl ethers, silicone-acrylic copolymers, polyurethanes, and polyesters, but are not limited thereto.

For simultaneous achievement of the high abrasion resistance and the high ink absorbency, the water-dispersible resin particles A is preferably any of the copolymers or modified copolymers of vinyl chloride, vinyl acetate, acrylic acid, urethane, polyester, and ethylene; more preferably any of two- or more component copolymers and modified copolymers of vinyl chloride-vinyl acetate, vinyl chloride-acrylic acid, vinyl acetate-acrylic acid, and styrene-acrylic acid.

The water-dispersible resin particles B is any of the copolymers or modified copolymers of vinyl chloride, vinyl acetate, acrylic acid, urethane, polyester, and ethylene; more preferably any of two or more component copolymers and modified copolymers of acrylic acid or vinyl chloride-vinyl acetate, vinyl chloride-acrylic acid, vinyl acetate-acrylic acid, and styrene-acrylic acid.

For formation of the ideal partially fusion-bonded structure of the porous layer, preferred monomeric combination of the water-dispersible resin particles A and B (component monomer of water-dispersible resin particle A/component monomer of water-dispersible resin B) includes vinyl chloride-vinyl acetate/acrylic acid, vinyl chloride-vinyl acetate/acrylate ester, vinyl chloride-vinyl acetate/vinyl chloride-acrylic acid, vinyl chloride-vinyl acetate/vinyl acetate-acrylic acid, vinyl chloride-acrylic acid/styrene-acrylic acid, acrylic acid/vinyl chloride-vinyl acetate, acrylate ester/vinyl chloride-vinyl acetate, vinyl chloride-acrylic acid/vinyl chloride-vinyl acetate, vinyl acetate-acrylic acid/vinyl chloride-vinyl acetate, and styrene-acrylic acid/vinyl chloride-acrylic acid.

In more preferable combination, some of the components of the water-dispersible resin particles A and B are commonly employed in both resins. Such combination (component monomer of water-dispersible resin particle A/component monomer of water-dispersible resin particle B) includes vinyl chloride-vinyl acetate/vinyl chloride-acrylic acid, vinyl chloride-vinyl acetate/vinyl acetate-acrylic acid, vinyl chloride-acrylic acid/styrene-acrylic acid, vinyl chloride-acrylic acid/vinyl chloride-vinyl acetate, vinyl acetate-acrylic acid/vinyl chloride-vinyl acetate, and styrene-acrylic acid/vinyl chloride-acrylic acid.

Similarly in three or more component copolymers, some of the components of the water-dispersible resin particles A and B are preferably commonly employed in both resins. Such combination (component monomer of water-dispersible resin particles A/component monomer of water-dispersible resin particles B) includes vinyl chloride-vinyl acetate-acrylic acid/vinyl acetate-acrylic acid, vinyl chloride-vinyl acetate-acrylic acid/vinyl chloride-acrylic acid, vinyl chloride-vinyl acetate-acrylic acid/styrene-acrylic acid, vinyl acetate-acrylic acid/vinyl chloride-vinyl acetate-acrylic acid, vinyl chloride-acrylic acid/vinyl chloride-vinyl acetate-acrylic acid, and styrene-acrylic acid/vinyl chloride-vinyl acetate-acrylic acid.

Presumably, this is due to the fact that the common component brings about an appropriate compatibility between the water-dispersible resin particles A and the water-dispersible resin particles B, in comparison with the combination of completely the same components or of completely different components, during the formation of the partially fusion-bonded structure in the mixture of the water-dispersible resin particles A and the water-dispersible resin particles B, thereby resulting in the ideal partially fusion-bonded structure. Hence the higher abrasion resistance and the higher ink absorbency are obtained.

For facilitating the partial fusion-bonding of the water-dispersible resin particles A and the water-dispersible resin particles B, a binder may be incorporated in a small amount insofar as the effects of the present invention are not decreased.

The particles of the water-dispersible resins A and B constitute the aforementioned porous structure initially. After printing, the porous structure is preferably transformed to a nonporous (transparent) structure by heat treatment or a like treatment to give weatherability and gloss to the print. In this treatment, a dyeing component such as a dye or a pigment of the ink which remains in the porous layer can impair the gloss of the print. Therefore, at least one of the water-dispersible resin particles A and the water-dispersible resin particles B is preferably non-dyeable, more preferably both of the water-dispersible resin particles A and B are non-dyeable.

The porous resin layer can be formed by applying a coating liquid mixture of the water-dispersible resin particles A and B having a solid matter content adjusted to 10–50 mass % onto a base material, and heat-treating and drying it.

The coating amount of the liquid mixture containing the water-dispersible resin particles A and B should be sufficient to give surface gloss without causing interference color by treatment of the printed matter and to serve as a protection film satisfactorily, usually in an amount to give a dried thickness ranging from 2 to 30 $\mu$m.

With a dried film thickness of less than 2 $\mu$m, the film does not serve effectively as a protection film, and has lower ink absorbency to cause ink feathering at the color boundary. With a dried film thickness of more than 30 $\mu$m, the ink diffuses in the porous layer to cause ink running at the color boundary and to make it difficult to obtain dot shapes of a perfect circle without causing ununiform color density.

The base material useful in the present invention may be either a transparent material or an opaque material, including paper such as wood-free paper, medium quality paper, art paper, bond paper, resin-coated paper, baryta paper, and coat paper; and films of plastic material such as polyethylene terephthalate, diacetate, triacetate, polycarbonate, polyethylene, and polyacrylate. In the case where the porous resin layer is constituted only of a porous layer containing thermoplastic resin particles, the base material is preferably a paper sheet or contains porous resin particles for the ink absorbency.

An ink-receiving layer may be provided between the porous resin layer and the base material. With such a recording medium, the applied ink penetrates the porous resin layer to reach the ink-receiving layer to form an image there.

The ink-receiving layer contains a pigment and is porous. The pigment useful therefor includes silica, calcium carbonate, and alumina hydrate. Of these, alumina hydrate is particularly preferred in view of dye fixability and the transparency.

The alumina hydrate can be produced by a known process such as hydrolysis of aluminum alkoxide, and hydrolysis of sodium aluminate. The alumina hydrate may be in a shape of a cilium, a needle, a plate, a spindle, or the like, and may be oriented or non-oriented. By use of the non-oriented alumina hydrate, high ink absorbency can be obtained and occurrence of beading can be prevented even with a smaller thickness of the alumina-hydrate-containing layer, advantageously.

The orientation in the ink-receiving layer can be confirmed by the procedure described below upon formation of the ink-receiving layer. The cross-section of the ink receiving layer in the thickness direction is bared. An electron beam is introduced to a part of the cross-section of the ink-receiving layer to obtain a transmission diffraction diagram. The state of the orientation is confirmed by emergence of concentric ring-shaped diffraction images, and using the diffraction intensity variation index $\delta$ represented by the equation (1) below. The diffraction intensity variation index $\delta$ of not higher than 5% shows non-orientation.

$$\delta=(Imax-Imin)/(Imax+Imin)\times 100 \quad (1)$$

where Imax indicates the maximum diffraction intensity of one ring-shaped diffraction image, and Imin indicates the minimum diffraction intensity thereof.

The presence of the alumina hydrate in a non-oriented state in the ink-receiving layer gives the diffraction intensity variation index $\delta$ of not higher than 5% regardless of the cross-section direction of the sample. The presence of the orientation is judged by the diffraction images of arbitrary two cross-sections perpendicular to each other which extende in the thicknesswise direction of the ink-receiving layer.

This diffraction intensity variation index $\delta$ is specifically derived by the method shown below. A layer containing the alumina hydrate is formed on a polyethylene terephthalate film. A sectional thin slice of 700±100 Å is prepared as a specimen to be measured. The cross-section of the alumina hydrate layer is subjected to an electron diffraction measurement with a transmission electron microscope (Model H-800, Hitachi, Ltd.). The diffraction intensity of the diffraction image is transferred onto an imaging plate (manufactured by Fuji Photo Film Co.), and the intensity distribution of the diffraction images of the respective lattice plane is measured. The diffraction intensity variation index is derived from the above equation (1). In the measurement, the diffraction in a restricted field of view is in a size of 2000 Åϕ, and ten spots are taken from different positions of the cross-section.

The alumina hydrate for use in the present invention may be a commercial product or a processed product thereof. The alumina preferably has characteristics of high transparency, high gloss, and high dye fixability, and more preferably not causing cracking in film formation, and giving good coating properties. The commercial product includes AS-2, and AS-3 (trade names, Shokubai Kasei K. K.); and 520 (trade name, Nissan Chemical Industries).

The non-oriented alumina hydrate can be prepared, for example, by hydrolysis-peptization of aluminum alkoxide, or hydrolysis-peptization of aluminum nitrate and sodium aluminate.

The alumina hydrate is usually a fine particle having a particle size of not more than 1 μm and highly dispersible, thereby giving high smoothness and high gloss to the recording medium.

The binder for binding the alumina hydrate may be selected from water-soluble polymers without limitation. Such water-soluble polymer includes polyvinyl alcohols and modified produces thereof; starch and modified products thereof; gelatin and modified products thereof; casein and modified products thereof; gum arabia; cellulose derivatives such as carboxymethylcellulose, hydroxyethylcellulose, and hydroxypropylmethylcellulose; conjugated diene copolymer latexes such as SBR latex, NBR latex, methyl methacrylate-butadiene copolymer latex; functional-group-modified polymer latexes; vinyl copolymer latexes such as ethylene-vinyl acetate copolymer latex: polyvinylpyrrolidone; maleic anhydride and its copolymers; and acrylate ester copolymers. These binders may be used singly or in combination of two or more thereof.

The alumina hydrate and the binder are mixed in a mass ratio ranging preferably from 1:1 to 30:1, more preferably from 5:1 to 25:1. With the binder in an amount lower than this range, the mechanical strength of the ink-receiving layer is insufficient to cause cracking or dusting, whereas with the binder in an amount higher than that range the pore volume is smaller to lower the ink absorbency.

The coating liquid for formation of the lower layer may contain, in addition to the alumina hydrate and the binder, an additive such as a dispersant, a thickening agent, a pH controller, a lubricant, a fluidity modifier, a surfactant, antifoaming agent, waterproofing agent, a releasing agent, a fluorescent whitener, a UV absorber, and an antioxidant, if necessary.

The alumina hydrate is applied on the base material in an amount preferably not less than 10 g/m$^2$ for the dye fixability. For a base material having no ink-absorbency, the alumina hydrate is applied in an amount ranging preferably from 30 to 50 g/m$^2$. For a base material having ink-absorbency, the alumina hydrate is applied in an amount ranging preferably from 20 to 40 g/m$^2$.

The coating-drying method is not limited specially. The alumina hydrate and the binder may be calcined, if necessary. The calcination increases the bridging strength of the binder to increase the mechanical strength of the ink-receiving layer and to improve the surface gloss of the alumina hydrate layer.

When using a paper sheet used as the base material, it is preferable to coat with barium sulfate the surface of the base paper sheet composed of a fibrous material, onto which recording is conducted, to obtain a Bekk surface smoothness of not less than 400 seconds, and a whiteness degree of not lower than 87% for obtaining an image comparable with that of the silver salt photograph.

The barium sulfate used therefor has an average particle size ranging preferably from 0.4 to 1.0 μm, more preferably from 0.4 to 0.8 μm. Use of the barium sulfate of the particle size in the above range will give the intended whiteness, gloss, and ink absorbency.

As the binder for binding the barium sulfate, gelatin is suitable, being used in an amount of 6–12 parts by mass based on 100 parts by mass of the barium sulfate.

The barium sulfate is applied onto the base material in a coating amount of 20–40 g/m$^2$.

An excessively high smoothness of the barium sulfate layer is liable to cause decrease in ink absorbency. Therefore, the smoothness is preferably not more than 600 seconds, more preferably not more than 500 seconds.

The coating liquid may contain, in addition to the alumina hydrate and the binder, an additive such as a dispersant, a thickening agent, a pH controller, a lubricant, a fluidity modifier, a surfactant, antifoaming agent, waterproofing agent, a releasing agent, a fluorescent whitener, a UV absorber, and antioxidant, if necessary.

In preparing the recording medium of the present invention, the aforementioned composition together with a necessary additive is dissolved or dispersed in water, an alcohol, a polyhydric alcohol, or a suitable organic solvent to prepare a coating liquid.

The resulting coating liquid is applied onto the base material surface by a coating method such as a roll coater method, a blade coater method, an air knife coater method, a gate roll coater method, a bar coater method, a size press method, a spray coating method, a gravure coater method, and a curtain coater method. Thereafter, the applied coating liquid is dried by a hot air drier, a heating drum, or the like to obtain the recording medium of the present invention.

As the method for applying the ink onto a recording medium, an ink-jet system is suitable which forms ink droplets by action of thermal energy applied to the ink in view of the simplicity, high speed printing, and print fineness.

For making the porous layer nonporous, a heat treatment is suitable. The heat treatment improves the weatherbility such as water resistance, and light fastness, making the printed image glossy, and enabling long-term storage of the printed matter.

The heat treatment temperature is preferably not lower than the minimum film-forming temperature of the water-dispersible resin particles. The temperature ranges preferably from 70° C. to 180° C. depending on the type of the water-dispersible resin particles in view of the surface properties after the porosity-decreasing treatment.

The heat-treatment temperature lower than 70° C. will give neither sufficient gloss nor sufficient performance as a protection film, and will render the water resistance insufficient. The heat-treatment temperature higher than 180° C. may deteriorate the base material to render the recorded matter unsatisfactory.

The present invention is described in below in more detail by reference to examples without limiting the invention in any way.

EXAMPLE 1

A coat paper sheet was prepared as the base material as follows. A coating liquid was prepared by mixing 100 parts by mass of particulate barium sulfate having an average particle size of 0.6 μm obtained by reaction of barium sulfate and barium chloride, 10 parts by mass of gelatin, 3 parts by mass of polyethylene glycol, and 0.4 mass part of chromium alum. This coating liquid was applied onto a base paper sheet having a basis weight of 130 g/m$^2$ and a Bekk smoothness of 340 seconds to obtain a dried thickness of 20 μm. The coated paper sheet was supercalendered to obtain a base material having a surface smoothness of 400 seconds.

Another coating liquid was prepared by mixing 100 parts by mass of vinyl chloride-vinyl acetate-acrylic acid copolymer (minimum film-forming temperature: 130° C., average particle size; 0.75 μm), and 10 parts by mass of styrene-acrylate ester copolymer (Movinyl 752, trade name, Hoechst Gosei K.K.; minimum film-forming temperature: 30° C., average particle size: 0.1 μm), and adjusting the solid matter content of the liquid mixture to 30%. The coating liquid was applied on the above-prepared base material by a bar coater, and dried at 60° C. for 10 minutes to form a porous layer of a thickness of about 20 μm. Thus a recording medium of the present invention was obtained.

The thus obtained porous layer was observed by SEM, and was confirmed to have partial fusion-bonding of the water-dispersible resin particles.

On this recording medium, an image was printed with the inks having the composition shown below by an ink-jet printer (BJC610JW, trade name, Canon K.K.). The recording medium was heat-treated at 140° C. to make the porous layer nonporous to obtain a recorded matter having a photographic image quality. Ink employed:

| Dyes | |
|---|---|
| Y: C.I. Direct Yellow 85 | |
| M: C.I. Acid Red 35 | |
| C: C.I. Direct Blue 199 | |
| M: C.I. Food Black 2 | |
| Ink Composition | |
| Dye | 3 parts |
| Glycerin | 7 parts |
| Thioglycol | 7 parts |
| Water | 83 parts |

The recorded matter was evaluated for the density, gloss, and weatherability of the black image. The recording medium was evaluated for abrasion resistance. Table 1 shows the results.

(a) Image density: The image density was measured by MacBeth Reflectodensitometer RD-918.
(b) Surface glossiness: Surface glossiness was measured by a digital angle-varying glossmeter (manufactured by Suga Tester K.K.) at angles of 20° and 75° according to JIS-P-8142.
(c) Water resistance: 0.03 mL of water was dropped onto the recorded matter. The one which does not cause ink flow was evaluated to be "good": the one which causes ink flow is evaluated to be "poor".
(d) Abrasion resistance: A 700-gram weight was placed on the recording medium and was allowed to rub the print. The one which is not scratched was evaluated to be "good": the one which is slightly scratched was evaluated to be "fair": the one which is remarkably scratched was evaluated to be "poor".
(e) Ink absorbency: The boundary between the yellow color and the red color was observed. The one which does not cause ink running was evaluated to be "good": the one which causes ink running was evaluated to be "poor".

EXAMPLE 2

A recording medium of the present invention was prepared in the same manner as in Example 1 except that acrylic-acid-modified colloidal silica (Movinyl 8030, trade name, Hoechst Gosei K.K.; minimum film-forming temperature: 30° C., average particle size: 0.06 μm) was used in place of the styrene-acrylate ester copolymer.

The thus obtained porous layer was observed by SEM, and was confirmed to have partial fusion-bonding of the water-dispersible resin particles.

With this recording medium, a print was prepared and evaluated in the same manner as in Example 1. Table 1 shows the results.

EXAMPLE 3

A recording medium of the present invention was prepared in the same manner as in Example 1 except that a vinyl acetate-acrylic acid copolymer (Movinyl 630, trade name, Hoechst Gosei K.K.; minimum film-forming temperature: 19° C., average particle size: 0.15 μm) was used in place of the styrene-acrylate ester copolymer.

The thus obtained porous layer was observed by SEM, and was confirmed to have partial fusion-bonding of the water-dispersible resin particles.

With this recording medium, a print was prepared and evaluated in the same manner as in Example 1. Table 1 shows the results.

EXAMPLE 4

A recording medium of the present invention was prepared in the same manner as in Example 3 except that the amount of the vinyl acetate-acrylic acid copolymer was changed to 20 parts by mass.

The thus obtained porous layer was observed by SEM, and was confirmed to have partial fusion-bonding of the water-dispersible resin particles.

With this recording medium, a print was prepared and evaluated in the same manner as in Example 1. Table 1 shows the results.

EXAMPLE 5

A recording medium of the present invention was prepared in the same manner as in Example 3 except that the amount of the vinyl acetate-acrylic acid copolymer was changed to 5 parts by mass.

The thus obtained porous layer was observed by SEM, and was confirmed to have partial fusion-bonding of the water-dispersible resin particles.

With this recording medium, a print was prepared and evaluated in the same manner as in Example 1. Table 1 shows the results.

COMPARATIVE EXAMPLE 1

A recording medium was prepared in the same manner as in Example 1 except that only the vinyl chloride-vinyl acetate-acrylic acid copolymer (minimum film-forming temperature: 130° C., average particle size: 0.75 μm) was used as the water-dispersible resin particles of the porous resin layer.

The thus obtained porous layer was observed by SEM, and was confirmed to have partial fusion-bonding of the water-dispersible resin particles.

With this recording medium, a print was prepared and evaluated in the same manner as in Example 1. Table 1 shows the results.

This recording medium is not satisfactory in the abrasion resistance of the porous layer. Many scratches were caused during printing on the surface of the recording medium. The scratches could not be erased even by the porosity-decreasing treatment.

COMPARATIVE EXAMPLE 2

A recording medium was prepared in the same manner as in Example 1 except that only a vinyl chloride-vinyl acetate copolymer (VINYBLAN 240, trade name, Nisshin Kagaku Kogyo K.K.; minimum film-forming temperature: 10° C., average particle size: 0.6 μm) was used as the water-dispersible resin particles of the porous resin layer.

The thus obtained porous layer was observed by SEM, and was confirmed to have partial fusion-bonding of the water-dispersible resin particles, but the porosity was low.

With this recording medium, a print was prepared and evaluated in the same manner as in Example 1. Table 1 shows the results.

COMPARATIVE EXAMPLE 3

A recording medium was prepared in the same manner as in Example 1 except that a mixture of 100 parts by mass of a vinyl chloride-vinyl acetate copolymer (VINYBLAN 240, trade name, Nisshin Kagaku Kogyo K.K.; minimum film-forming temperature: 10° C., average particle size: 0.6 μm) and 10 parts by mass of styrene-acrylate ester copolymer (Movinyl 756, trade name, Hoechst Gosei K.K.; minimum film-forming temperature: lower than 0° C., average particle size: 0.06 μm) was used as the water-dispersible resin particles of the porous resin layer.

The thus obtained porous layer was observed by SEM, and was confirmed to have partial fusion-bonding of the water-dispersible resin particles partially fusion-bonded, but the porosity was low.

With this recording medium, a print was prepared and evaluated in the same manner as in Example 1. Table 1 shows the results.

COMPARATIVE EXAMPLE 4

A recording medium was prepared in the same manner as in Comparative Example 3 except that a vinyl chloride-acrylate ester copolymer (VINYBLAN 270, trade name, Nisshin Kagaku Kogyo K.K.; minimum film-forming temperature: 0° C., average particle size: 0.6 μm) was used in place of the styrene-acrylate ester copolymer.

The thus obtained porous layer was observed by SEM, and was confirmed to have partial fusion-bonding of the water-dispersible resin particles, but the porosity was very low.

With this recording medium, a print was prepared and evaluated in the same manner as in Example 1. Table 1 shows the results.

COMPARATIVE EXAMPLE 5

A recording medium was prepared in the same manner as in Example 1 except that a mixture of 100 parts by mass of a styrene-acrylate ester copolymer (Movinyl 752, trade name, Hoechst Gosei K.K.; minimum film-forming temperature: 30° C., average particle size: 0.1 μm) and 10 parts by mass of a styrene-acrylate ester copolymer (Movinyl 756, trade name, Hoechst Gosei K.K.; minimum film-forming temperature: lower than 0° C., average particle size: 0.06 μm) was used as the water-dispersible resin particles of the porous resin layer.

The thus obtained porous layer was observed by SEM, and was confirmed to have partial fusion-bonding of the water-dispersible resin particles, but the porosity was very low.

With this recording medium, a print was prepared and evaluated in the same manner as in Example 1. Table 1 shows the results.

EXAMPLE 6

Preparation Example of Alumina Hydrate

The alumina hydrate employed in the present invention was prepared by the procedure described below. Aluminum octoxide was synthesized according to the process disclosed in U.S. Pat. No. 4,242,271, and was hydrolyzed to obtain an alumina slurry. This alumina slurry was diluted with water to a solid alumina hydrate content of 5 mass, and was aged at 80° C. for 10 hours. This colloidal sol was spray-dried to obtain alumina hydrate. This alumina hydrate was mixed and dispersed with deionized water. The pH of the mixture was adjusted to pH 10 by addition of nitric acid. This mixture was aged for 5 hours to obtain a colloidal sol. This colloidal sol was desalted, and was peptized by addition of acetic acid. The alumina hydrate obtained from this colloidal sol by drying was subjected to an X-ray diffraction measurement, and was found to have a pseudo-boehmite structure. Observation by transmission electron microscopy shows that this pseudo-boehmite is in a shape of a spindle.

The colloidal sol of alumina hydrate obtained above was concentrated to 15 mass %. On the other hand, a polyvinyl alcohol (PVA117, trade name, Kuraray Co.) was dissolved in deionized water to prepare a 10 mass % solution. These two solutions were mixed at a solid matter ratio of 10:1 (mass ratio), and stirred to obtain a liquid dispersion.

This liquid dispersion was applied by die-coating on a polyethylene terephthalate film to form a porous ink-receiving layer containing the pseudo-boehmite. The porous ink-receiving layer had a thickness of about 40 μm.

Observation of the cross-section of this ink-receiving layer by a transmission electron microscopy revealed that the spindle-shaped pseudo-boehmite was contained in a non-oriented condition. The aforementioned diffraction intensity variation index δ of this layer was 1.0%.

On the thus obtained ink-receiving layer, the same porous resin layer as in Example 1 was formed to obtain a recording medium of the present invention. The resulting porous resin layer was observed by SEM, and was confirmed to have partial fusion-bonding of the water-dispersible resin particles.

With this recording medium, a print was prepared and evaluated in the same manner as in Example 1. Table 2 shows the results.

EXAMPLE 7

A recording medium of the present invention was prepared in the same manner as in Example 6 except that the porous resin layer of Example 6 was replaced by the same porous resin layer as in Example 2. A print was prepared with this recording medium in the same manner as in Example 1. Table 2 shows the evaluation results.

EXAMPLE 8

A recording medium of the present invention was prepared in the same manner as in Example 6 except that the porous resin layer of Example 6 was replaced by the same porous resin layer as in Example 3. A print was prepared with this recording medium in the same manner as in Example 1. Table 2 shows the evaluation results.

EXAMPLE 9

A recording medium of the present invention was prepared in the same manner as in Example 6 except that the porous resin layer of Example 6 was replaced by the same porous resin layer as in Example 4. A print was prepared with this recording medium in the same manner as in Example 1. Table 2 shows the evaluation results.

EXAMPLE 10

A recording medium of the present invention was prepared in the same manner as in Example 6 except that the porous resin layer of Example 6 was replaced by the same porous resin layer as in Example 5. A print was prepared with this recording medium in the same manner as in Example 1. Table 2 shows the evaluation results.

EXAMPLE 11

A recording medium of the present invention was prepared by providing the same ink-receiving layer as in Example 6 on the same base material as in Example 1, and providing the same porous resin layer as in Example 3 on the ink-receiving layer. A print was prepared with this recording medium in the same manner as in Example 1. Table 2 shows the evaluation results.

COMPARATIVE EXAMPLE 6

A recording medium was prepared in the same manner as in Example 6 except that only the vinyl chloride-vinyl acetate-acrylic acid copolymer (minimum film-forming temperature: 130° C., average particle size: 0.75 μm) was used as the water-dispersible resin particles of the porous resin layer.

The thus obtained porous layer was observed by SEM, and was confirmed to have partial fusion-bonding of the water-dispersible resin particles.

With this recording medium, a print was prepared and evaluated in the same manner as in Example 1. Table 2 shows the results.

This recording medium is not satisfactory in the abrasion resistance of the porous layer. Many scratches were caused during printing on the surface of the recording medium. The scratches could not be erased even by the porosity-decreasing treatment.

COMPARATIVE EXAMPLE 7

A recording medium was prepared in the same manner as in Example 6 except that only the vinyl chloride-vinyl acetate copolymer (VINYBLAN 240, trade name, Nisshin Kagaku Kogyo K.K.; minimum film-forming temperature: 10° C., average particle size: 0.6 μm) was used as the water-dispersible resin particles of the porous resin layer.

The thus obtained porous layer was observed by SEM, and was confirmed to have partial fusion-bonding of the water-dispersible resin particles, but the porosity was low.

With this recording medium, a print was prepared and evaluated in the same manner as in Example 1. Table 2 shows the results.

COMPARATIVE EXAMPLE 8

A recording medium was prepared in the same manner as in Example 6 except that a mixture of 100 parts by mass of the vinyl chloride-vinyl acetate copolymer (VINYBLAN 240, trade name, Nisshin Kagaku Kogyo K.K.; minimum film-forming temperature: 10° C., average particle size: 0.6 μm) and 10 parts by mass of styrene-acrylate ester copolymer (Movinyl 756, trade name Hoechst Gosei K.K.; minimum film-forming temperature: lower than 0° C., average particle size: 0.06 μm) was used as the water-dispersible resin particles of the porous resin layer.

The thus obtained porous layer was observed by SEM, and was confirmed to have partial fusion-bonding of the water-dispersible resin particles, but the porosity was low.

With this recording medium, a print was prepared and evaluated in the same manner as in Example 1. Table 2 shows the results.

COMPARATIVE EXAMPLE 9

A recording medium was prepared in the same manner as in Example 8 except that the vinyl chloride-acrylate ester copolymer (VINYBLAN 270, trade name, Nisshin Kagaku Kogyo K.K.; minimum film-forming temperature: 0° C., average particle size: 0.6 μm) was used in place of the styrene-acrylate ester copolymer of Comparative Example 8.

The thus obtained porous layer was observed by SEM, and was confirmed to have partial fusion-bonding of the water-dispersible resin particles, but the porosity was very low.

With this recording medium, a print was prepared and evaluated in the same manner as in Example 1. Table 2 shows the results.

COMPARATIVE EXAMPLE 10

A recording medium was prepared in the same manner as in Example 6 except that a mixture of 100 parts by mass of the styrene-acrylate ester copolymer (Movinyl 752, trade name, Hoechst Gosel K.K.; minimum film-forming temperature: 30° C., average particle size: 0.1 μm) and 10 parts by mass of a styrene-acrylate ester copolymer (Movinyl 756, trade name, Hoechst Gosei K.K.; minimum film-forming temperature: lower than 0° C., average particle size: 0.06 μm) was used as the water-dispersible resin particles of the porous resin layer.

The thus obtained porous layer was observed by SEM, and was confirmed to have partial fusion-bonding of the water-dispersible resin particles, but the porosity was very low.

With this recording medium, a print was prepared and evaluated in the same manner as in Example 1. Table 2 shows the results.

As described above,the present invention provides a novel recording medium having high ink absorbency and high abrasion resistance.

TABLE 1

| | Mixing ratio | Image density black | Glossiness 20° | Glossiness 75° | Water resistance | Abrasion resistance | Ink-absorbency yellow/red boundary |
|---|---|---|---|---|---|---|---|
| Example | | | | | | | |
| 1 | 100/10 | 1.91 | 64 | 94 | good | good | good |
| 2 | 100/10 | 1.87 | 54 | 94 | good | good | good |
| 3 | 100/10 | 1.93 | 62 | 93 | good | good | good |
| 4 | 100/20 | 1.98 | 68 | 90 | good | good | good |
| 5 | 100/5 | 1.92 | 66 | 93 | good | good | good |

TABLE 1-continued

| | Mixing ratio | Image density black | Glossiness 20° | Glossiness 75° | Water resistance | Abrasion resistance | Ink-absorbency yellow/red boundary |
|---|---|---|---|---|---|---|---|
| Comparative Example | | | | | | | |
| 1 | 100/0 | 1.90 | 56 | 95 | good | poor | good |
| 2 | 100/0 | 1.72 | 49 | 92 | good | fair | poor |
| 3 | 100/10 | 1.92 | 47 | 90 | good | good | poor |
| 4 | 100/10 | 1.90 | 47 | 90 | good | good | poor |
| 5 | 100/10 | 1.92 | 50 | 90 | good | good | poor |

TABLE 2

| | Mixing ratio | Image density black | Glossiness 20° | Glossiness 75° | Water resistance | Abrasion resistance | Ink-absorbency yellow/red boundary |
|---|---|---|---|---|---|---|---|
| Example | | | | | | | |
| 6 | 100/10 | 1.91 | 79 | 94 | good | good | good |
| 7 | 100/10 | 1.87 | 60 | 94 | good | good | good |
| 8 | 100/10 | 1.93 | 75 | 93 | good | good | good |
| 9 | 100/20 | 1.98 | 68 | 90 | good | good | good |
| 10 | 100/5 | 1.92 | 77 | 93 | good | good | good |
| 11 | 100/10 | 1.93 | 65 | 93 | good | good | good |
| Comparative Example | | | | | | | |
| 6 | 100/0 | 1.90 | 46 | 95 | good | poor | good |
| 7 | 100/0 | 1.72 | 39 | 92 | good | fair | poor |
| 8 | 100/10 | 1.92 | 35 | 90 | good | good | poor |
| 9 | 100/10 | 1.90 | 35 | 90 | good | good | poor |
| 10 | 100/10 | 1.92 | 40 | 90 | good | good | poor |

What is claimed is:

1. An ink-jet recording medium having, on a base material, a porous resin layer containing water-dispersible resin particles B having a minimum film-forming temperature of not lower than 0° C., and water-dispersible resin particles A having a minimum film-forming temperature higher than the film-forming temperature of the water-dispersible resin particles B and having an average particle size larger than the average particle size of the water-dispersible resin particles B.

2. The ink-jet recording medium according to claim 1, wherein particles of the water-dispersible resin particles A and particles of the water-dispersible resin particles B are partially fusion-bonded.

3. The ink-jet recording medium according to claim 1, wherein the difference between the minimum film-forming temperature of the water-dispersible resin particles A and the minimum film-forming temperature of the water-dispersible resin particles B is not less than 50° C.

4. The ink-jet recording medium according to claim 3, wherein the difference in the minimum film-forming temperatures is not less than 60° C.

5. The ink-jet recording medium according to claim 3, wherein the difference in the minimum film-forming temperatures is not less than 70° C.

6. The ink-jet recording medium according to claim 1, wherein the water-dispersible resin particles A have an average particle size ranging from 0.1 to 10 $\mu$m.

7. The ink-jet recording medium according to claim 1, wherein the water-dispersible resin particles B have an average particle size ranging from 0.01 to 0.3 $\mu$m.

8. The ink-jet recording medium according to claim 1, wherein the water-dispersible resin particles A are selected from the group consisting of copolymers of vinyl chloride, vinyl acetate, acrylic acid, urethane, poly ester, and ethylene, and modified products thereof.

9. The ink-jet recording medium according to claim 1, wherein the water-dispersible resin particles A are selected from the group consisting of two or more component copolymers of vinyl chloride-vinyl acetate, vinyl chloride-acrylic acid, vinyl acetate-acrylic acid, and styrene-acrylic acid, and modified products thereof.

10. The ink-jet recording medium according to claim 1, wherein the water-dispersible resin particles B are selected from the group consisting of copolymers of vinyl chloride, vinyl acetate, acrylic acid, urethane, polyester, and ethylene, and modified products thereof.

11. The ink-jet recording medium according to claim 1, wherein the water-dispersible resin particles B are selected from the group consisting of two or more component copolymers of acrylic acid, vinyl chloride-vinyl acetate, vinyl chloride-acrylic acid, vinyl acetate-acrylic acid, and styrene-acrylic acid, and modified products thereof.

12. The ink-jet recording medium according to claim 1, wherein the base material has a barium sulfate layer on the surface of a base paper sheet.

13. The ink-jet recording medium according to claim 1, wherein an ink-receiving layer is provided between the porous resin layer and the base material.

14. The ink-jet recording medium according to claim 1, wherein an ink-receiving layer is provided on both surfaces of the base material.

* * * * *

UNITED STATES PATENT AND TRADEMARK OFFICE

CERTIFICATE OF CORRECTION

PATENT NO. : 6,730,375 B2
DATED : May 4, 2004
INVENTOR(S) : Kenichi Moriya et al.

It is certified that error appears in the above-identified patent and that said Letters Patent is hereby corrected as shown below:

Column 1,
Line 64, “No. 62-1.40878” should read -- No. 62-140878 --.

Column 6,
Line 38, “extende” should read -- extend --.

Column 7,
Line 8, “produces” should read -- products --.

Column 8,
Line 26, “weatherbility” should read -- weatherability --.

Column 11,
Line 67, “mass,” should read -- mass %, --.

Column 16,
Line 38, “poly ester,” should read -- polyester, --.

Signed and Sealed this

Fourteenth Day of September, 2004

JON W. DUDAS
*Director of the United States Patent and Trademark Office*